United States Patent [19]

Genter

[11] Patent Number: 4,938,412

[45] Date of Patent: Jul. 3, 1990

[54] MANUFACTURE OF COLORED EGG PACKAGES

[76] Inventor: Vagn Genter, 35, Hoejrups Alle, Hellerup, Denmark, DK-2900

[21] Appl. No.: 314,534

[22] PCT Filed: Jun. 10, 1988

[86] PCT No.: PCT/DK88/00090

§ 371 Date: Feb. 21, 1989

§ 102(e) Date: Feb. 21, 1989

[87] PCT Pub. No.: WO88/10337

PCT Pub. Date: Dec. 29, 1988

[30] Foreign Application Priority Data

Jun. 19, 1987 [DE] Fed. Rep. of Germany ..... 3520265

[51] Int. Cl.[5] ..... B65D 85/32

[52] U.S. Cl. ..... 229/2.5 EC; 8/919; 118/324; 118/642; 264/78; 264/129; 427/236; 427/391; 427/395; 427/421; 493/148; 493/328; 493/913

[58] Field of Search ..... 229/2.5 EC, 2.5 R; 220/4 B; 493/148, 149, 328, 330, 913; 118/46, 58, 324, 642; 8/919; 427/236, 388.5, 391, 395, 416, 421; 264/78, 129, 132

[56] References Cited

U.S. PATENT DOCUMENTS

| | | | |
|---|---|---|---|
| 2,704,493 | 3/1955 | Randall | 229/2.5 EC |
| 2,899,930 | 8/1959 | Stanley et al. | 118/58 |
| 3,070,064 | 12/1962 | Busse | 118/324 |
| 3,275,213 | 9/1966 | Reifers | 229/2.5 EC |
| 3,425,396 | 2/1969 | Margola | 118/324 |
| 4,197,344 | 4/1980 | Tshudy | 118/58 |
| 4,202,852 | 5/1980 | Pauls et al. | 264/115 |
| 4,610,216 | 9/1986 | Paulsen | 118/46 |
| 4,783,344 | 11/1988 | Brauet et al. | 427/421 |

*Primary Examiner*—Gary Elkins

*Attorney, Agent, or Firm*—Pennie & Edmonds

[57] ABSTRACT

The invention relates to a method for the manufacture of colored egg packages, apparatus for carrying such a method into effect and egg packages manufactured by this method. The invention concerns a method for the manufacture of colored egg packages (6) made from wood pulp and/or waste paper (paper pulp) in which the egg package receives its final outside color only after the moulding phase by subsequently spraying-on (3) a dye, an apparatus for the carrying such a method into effect and egg packages manufactured by this method.

30 Claims, 1 Drawing Sheet

MANUFACTURE OF COLORED EGG PACKAGES

TECHNICAL FIELD

The invention concerns a method for the manufacture of coloured egg packages from wood pulp and/or from waste paper or paper pulp, an apparatus for carrying such a method into effect, and the product resulting from this method.

BACKGROUND ART

Egg packages made from wood pulp and/or waste paper pulp have a white or a more or less grayish ground colour. This grayish colour shade depends among others upon the proportion of waste paper used, as well as upon the degree to which this waste paper was printed. Removal of this grayish shade, or brightneing, can be achieved by subjecting the waste paper to a de-inking process, by which a considerable part of the printing ink is removed.

In order to provide coloured egg packages, a chemical dye is added to the white or gray pulp, before egg packages with a corresponding colour are made of said pulp. This procedure has several appreciable disadvantages. For each single colour it is necessary to produce a specially coloured pulp. The egg packages are manufactured in a plant by means of suction moulds, mounted on a suction wheel, and it is necessary that suction moulds for a large number of different type of egg packages must always be at hand. When changing from one colour to another, or when changing from one package type to another, a change-over time for the plant of one hour or more may be necessary. During this time, nothing can be produced in the plant. Another disadvantage is that when colouring the pulp, an additional 99% water must be coloured, which means a very high consumption of dye. For this reason, a considerable amount of coloured water is produced, which is difficult to clarify. Large clarifying reserviors are needed for this purpose. The waste water of certain colour coming from the production process can only be re-used for new production of a pulp having the same colour. Furthermore is it difficult to adjust the colour shade when using the conventional method of manufacture, because it must be considered on a wet product. This insufficient control possibility leads to scrapping of approximately 10% of the egg packages. Furthermore, the control of the colouring is extremely difficult as the content of dye in the pulp only amounts to approximately 0.003% for obtaining the desired colour shade. In addition to this, the colour of the pulp will change uncontrollably according to the condition of the waste paper employed, as well as to the proportion of waste paper in the pulp, which is responsible for the various shades of gray to be found in the pulp. Another disadvantage is that once a coloured pulp has been introduced, it must be used up the same day. Because the dye also bonded in the pulp in the finished egg packages, the colour will lose some of its brilliance and soon fade. Nor should it be overlooked that the dye will be in contact with the packed eggs. All these problems have been greatly aggravated with the increasing number of package types and the increasing variety of desired colours. Nevertheless, for lack of alternative solutions, the same manufacturing methods have been used and are still used worldwide today.

SUMMARY OF THE INVENTION

On the basis of these considerations, the object of the invention is to suggest a method of the before-mentioned kind, which can be executed in a more economic and more variated manner, and which will lead to an improved product resulting from the process.

That problem is solved by this invention, substantially in that way that the egg packages only receives its final colouring after the moulding phase by means of subsequent spraying-on a dye. The basic body of the egg package, which results from the moulding phase, will be mainly white or gray, and it will be the same for all types of egg packages, independent of the final outward colour thereof.

In this way, a number of advantages is obtained. One and only one paper pulp may be used as the raw material for egg packages having many different colourings. When changing over the plant from one type of package to another, the latter colouring process will be of no consequence, as the type of paper pulp for the manufacture of all the basic bodies for all package types and for all final colours will be the same. Thus, the change-over can be executed rapidly and without problems, just by replacement of the suction moulds. It is also easier to build up a stock. It is also rapid and easy to change over from one colour to another, as the plant only needs to be connected to a container for a different colour. In this way, it is possible to reduce the halt time for the plant considerably, and at the same time scrapping of defectively coloured egg packages is almost done away with. As the dye is sprayed on, differences in the primarily gray or white basic colour of the basic package body are covered by the dye. The surface will appear with the desired brilliance, because the dye is deposited on the surface of the package. The consumption of dye is reduced, as it is not necessary to dye the whole paper pulp. The colour shade of the sprayed package can be measured immediately and positively adjusted, as the pigment content in the dye is approx. 5–10% instead of only 0.003% in the paper pulp according to the convgentional method. And it is not necessary to solve waste water problems, which request large clarifying reservoirs. By adopting spray nozzles, the new method according to this invention allows extremely high production rates, for instance it will be possible to manufacture several hundreds of packages per minute.

A further important advantage of the manufacturing process according to this invention, will be obtained if only the outer surface of the egg package is sprayed with dye. If the package is a carton comprising a bottom portion and a lid, and the carton is in its closed position, when said two halves are folded against each other, the package will appear as a whole with only one, i.e. the desired colour. On the other hand, and contrary to coloured egg packages manufactured in traditional ways, the eggs in the carton will not be in direct contact with the dye, i.e. that possible detrimental effects, which might arise by such a contact, need to be taken in consideration when electing the dye.

Normally, a dye is employed containing an organic pigment material or a dispersion pigment material.

In order to prevent soaking of the dye, the pigment particles in the dye material is preferably surface-treated with a moistening agent. In this way a better moistening with the binder of the dyes is obtained, with the result that the pigment particles cannot break away from the desiccated dye.

The dye normally contains a water-soluble polymer as a binder.

Another specifically advantageous feature of the invention is that the dye contains a wax, preferably a micronized poly-ethylene wax. Several substantial advantages are obtained in this way: If the water, contained in the sprayed-on dye, would be absorbed in the package mateiral, the pulp fibres would inevitably rise at package surface, said surface thus becoming extremely rough. The content of wax in the dye, which may be approx. 0.5% by weight, will hinder the absorption of the water, and at the same time the possibility of an evaporation of the same time the possibility of an evaporation of the water content of the dye to the outside will be increased. Furthermore, the wax content will give an extra smoothness to the surface, which will greatly facilitate the de-nesting of the packages from a pile. Moreover, there is less danger of damage to the skin of the fingers of those persons, who constantly handle such packages. Furthermore will the wax content improve the possibility of breathing through the open pores in the surface. The wax will settle almost like a network over the surface. The smoothening of the surface, which is provided by the waxing, results in making it easier to subsequently print the package with information about place of origin, content etc. Moreover, the wax will improve the brilliance of the shade of colour.

Another specifically preferred feature of the invention is that the particle size of the pigment particles in the dye is somewhere between 0.15 and $0.30\times10^{-6}$ m. The size of the pigment particles is therefore considerably smaller than that of the normally used spray dyes, which are normally of a magnitude of approximately $20\text{–}30\times10^{-6}$ m. this feature gives a considerably improved covering and a far better atomization for spray-dye, which is also an important improvement as regards the high production rate of several hundreds of packages per minute.

As it is of importance to hinder penetration of water into the package material, according to the invention the water content in the dye may be evaporated immediately after the spraying-on of the dye, by means of a quick-acting heating, for instance infra-red radiation and/or hot air. By means hereof, it will be possible to obtain the above mentioned high production rate with relatively simple measures.

Immediately after the spray application and drying of the dye, the egg package can be printed with the desired information about place of origin, content etc.

The invention also concerns an apparatus for the carrying-out of the oabove process, comprising de-nesting means for the consecutive delivery of egg packages, which not yet have their final colour, from a stack and for depositing said packages on a conveyor device with a predetermined mutual distance, a spray battery placed above a first processing section of said transport device, adapted for the spraying-on of a dye on the egg packages, moving below said spray battery,a nd with a drying battery above a further processing section of said transport device, in the moving direction of this device after said spray battery, adapted to achieve a rapid drying of the sprayed-on dye by means of heating, e.g. infra-red radiation and/or hot air. The dye itself may be sprayed on at a raised temperature, e.g. by means of pre-heated nozzles, which may be advantageous in regard to the wax content and increases the evaporation speed of the water content after the spray-dying.

Preferably, the egg packages will be transported from said de-nesting device to said first processing section of the conveyor device with a greater mutual distance and with a higher speed, than below the spray battery and below the drying battery. In this way, regard will be paid to the greater distance necessary for the de-nesting. The lower transport speed and the smaller distance under the spray battery and the drying battery are advantageous because of the longer stay time in the spray time and drying time, and in addition the loss of dye between each single egg package is reduced.

According to the invention, this may be advantageously achieved by shifting the egg packages on their way of transport before the spray battery from a faster moving conveyor belt to a slower moving conveyor belt, which moves the egg packages below the spray battery, and below the drying battery.

After the dye drying process, the egg packages may be shifted to a third conveyor belt, which preferably runs at a higher speed than the conveyor belt below the spray battery and below the drying battery, and to which belongs a printing apparatus. The egg packages will then again have a greater mutual distance, which is necessitated in order to leave sufficient room for the printing cylinder.

This invention furthermfore comprises an egg package, which is manufactured by means of the above mentioned method. Such an egg package consists of a basic body, made of wood pulp and/or waste paper (paper pulp), the surface of which carries a coat of sprayed-on dye.

The sprayed-on coat of dye is preferably only on the outer package surface of the basic body.

The sprayed-on coat of dye contains preferably an organic pigment dye respectively a dispersion dye.

In another version of this invention, the sprayed on coat of dye contains a water-soluble polymer as a binder.

Based upon the above mentioned reasons, a special advantage may be achieved if the sprayed-on coat of dye contains a wax, preferably a micronized poly-ethylene wax.

In order to obtain a particularly good covering, it is important that the pigment particle size in the sprayed-on coat of dye is preferably between approx. 0.15 and $0.30\times10^{-6}$ m.

DETAILED DESCRIPTIÓN OF THE PREFERRED EMBODIMENTS

Figures 1, 2:
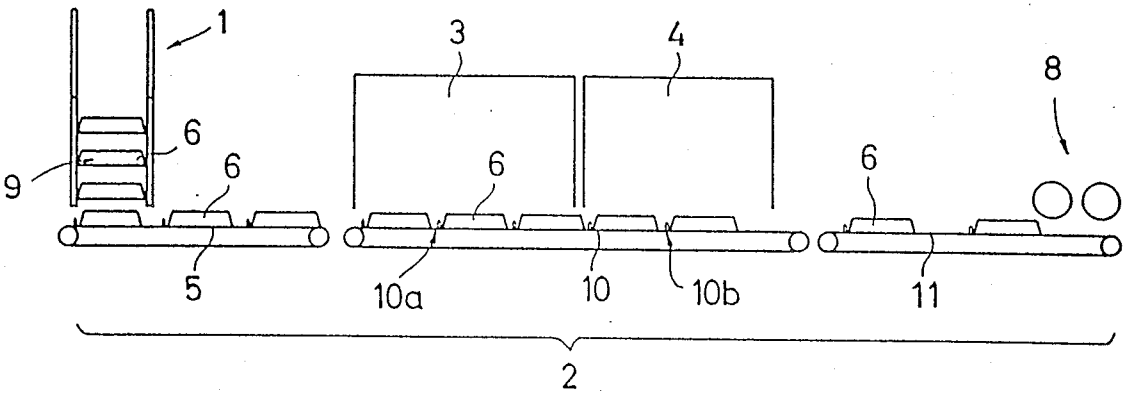
FIG. 1 illustrates in a schematic way a possible embodiment of an apparatus for carrying the method of this invention into effect, and FIG. 2 an embodiment of an egg packing formed as a carton.

From a de-nesting device 1 egg package bodies, which have not yet been given their final colour and therefore are gray or white, and which comprise an egg-receiving bottom part and a lid hinged to said part, are placed with a pre-determined mutual distance on a conveyor device 2, in opened condition, and with the outward surface of the packages upwards. The distance between the bodies is relatively great in order to facilitate the de-nesting of the individual egg trays 6, and is determined by the relatively high speed of a first conveyor belt 5 in the complete conveyor device 2, placed below the de-nesting device 1. A second conveyor belt 10 follows the first conveyor belt 5 in the conveyor device 2. Above the first process section 10*a* of the conveyor belt 10 is placed a spray battery 3, which sprays dye on the outer surface of the egg packages 6, which are opened as shown in FIG. 2 for providing a coat of sprayed-on dye 7. Above another process section 10*b* of the conveyor belt 10 is placed a drying battery 4, containing a number of infra-red radiators and/or hot air blowers, which will evaporate the water content in the sprayed-on coat of dye 7 on the egg packages 6 as rapidly as possible. The conveyor belt 10 runs at a lower speed than the conveyor belt 5. because of this, the distance between the egg packages is reduced, when they move from the first conveyor belt 5 to the second conveyor belt 10. This means that the egg packages 6 move below the spray battery 3 and the drying battery 4 with a smaller mutual distance, and at a lower speed, which means that there is sufficient time for the spraying process and for the drying process. As the egg packages 6 are placed closer together on the conveyor belt 10, less dye is lost between the egg packages 6 during the spraying process. From the conveyor belt 10, the sprayed and dried egg packages 6 move over to a third conveyor belt 11 in the conveyor device 2, which runs below a printing apparatus 8. In this section the egg packages 6 are on their outside provided with the necessary information about place of origin and content. As the third conveyor belt 11 again runs faster than the second conveyor belt 10, the distance between the egg packages 6 increases when they shift from conveyor belt 10 to conveyor belt 11, whereby the distance between the egg packages needed for the proper operation of the printing cylinders on the printing apparatus 8 is achieved. After this, the egg packages 6 provided with the desired colour are transported to a store room or prepared for shipping. If egg packages of another colour are wanted, it is only necessary to feed a different dye through the spray nozzles in the spray battery 3, and this change can be undertaken rapidly.

I claim:

1. Method for manufacturing coloured egg packages from a pulp, charcterized in that the egg package receives a final outside colour after the package is molded by spraying a dye onto the package.

2. Method according to claim 1, characterized in that the egg package is sprayed with dye only on an outer surface.

3. Method according to claim 1, characterized in that the dye which is employed contains an organic pigment material in the form of particles.

4. Method according to claim 1, characterized in that the dye which is employed contains a dispersion pigment material in the form of particles.

5. Method according to claim 4, characterized in that the pigment particles in the dye have been surface-treated with a moistening agent.

6. Method according to claim 1, characterized in that the dye contains a water-soluble polymer as a binder.

7. Method according to claim 1, characterized in that the dye contains a wax.

8. Method according to claim 3, characterized in that the pigment particles in the dye have a size between about 0.15 and $0.3\times10^{-6}$ m.

9. Method according to claim 1, characterized in that water present in the dye is evaporated after spraying onto the packages by means of a quick acting heater.

10. Method according to claim 1, characterized in that the egg packages are printed after spraying and drying of the dye.

11. Method according to claim 1, wherein the pulp is selected from one of a wood pulp or a waste paper pulp.

12. Method according to claim 1, wherein the water content of the dye is evaporated after spraying onto the packages by exposure to one of infrared radiation or hot air.

13. Method according to claim 4, characterized in that the pigment particles in the dye have a size between about 0.15 and $0.3\times10^{-6}$ m.

14. Method according to claim 7, wherein the wax is a micronized poly-ethylene wax.

15. A molded egg package consisting essentially of a basic body (6) made from a pulp which molded package carries a sprayed-on coat of dye.

16. Egg package according to claim 15, characterized in that the sprayed-on coat of dye (7) is only placed on an outer surface of the basic body (6).

17. Egg package according to claim 15, characterized in that the sprayed-on coat of dye (7) contains an organic pigment colouring material in the form of particles.

18. Egg package according to claim 15, characterized in that the sprayed-on coat of dye (7) contains a dispersion colouring material in the form of particles.

19. Egg package according to claim 15, characterized in that the sprayed-on coat of dye (7) contains a water-soluble polymer as a binder.

20. Egg package according to claim 15, characterized in that the sprayed-on coat of dye (7) contains a wax.

21. Egg package according to claim 17, characterized in that the particle size of the pigment particles in the sprayed-on coat of dye (7) is between about 0.15 and $0.3\times10-6$ m.

22. Egg package according to claim 15, characterized in that the sprayed-on coat of dye (7), in certain areas includes a printed colour layer.

23. Egg package according to claim 15, wherein the pulp is a wood pulp or a waste paper pulp.

24. Egg package according to claim 18, characterized in that the particle size of the pigment particles in the sprayed on coat of dye is between about 0.15 and $0.3\times10^{-6}$ m.

25. Egg package according to claim 20, wherein the wax is a micronized poly-ethylene wax.

26. Egg package according to claim 15 further consisting essentially of a printed color layer on selected areas of said package.

27. An apparatus for manufacturing coloured egg packages comprising de-nesting means (1) for the consecutive delivery of egg packages (6) which not yet have their final colour from a stack (9) and for depositing said packages on a conveyor device (2) with a predetermined mutual distance; a spray battery (3) placed above a first processing section (10*a*) of said conveyor device (2) adapted for the spraying-on of a dye on the egg packages which are moving below said spray battery (3); and a drying battery (4) above a second processing section (10*b*) of said conveyor device (2) in the moving direction of the egg packages after said spray battery (3) adapted to achieve a rapid drying of the sprayed-on dye by heating means.

28. Apparatus according to claim 11, characterized in that the egg packages (6) are transported from said de-nesting device (1) to said first processing section (10*a*) of the conveyor device (2) with a greater mutal distance and with a higher speed, than below the spray battery (3) and below the drying battery (4).

29. Apparatus according to claim 12, characterized in that the egg packages (6) on their way of transport before the spray battery (3) are shifted from a faster moving conveyor belt (5) to a slower moving conveyor belt (10), which moves the egg packages (6) below the spray battery (3) and below the drying battery (4).

30. Apparatus according to claim 29, characterized in that the egg packages (6) after the drying of the dye are shifted to a third conveyor belt (11), which runs at a higher speed than the conveyor belt (10) below the spray battery (3) and below the drying battery (4), and to which belongs a printing apparatus (8).

* * * * *

UNITED STATES PATENT AND TRADEMARK OFFICE

CERTIFICATE OF CORRECTION

PATENT NO. : 4,938,412

DATED : July 3, 1990

INVENTOR(S) : Vagn Genter

It is certified that error appears in the above-identified patent and that said Letters Patent is hereby corrected as shown below:

At column 6, line 65, please delete "11" and insert therefor --27--; and

At column 7, line 3, please delete "12" and insert therefor --28--.

Signed and Sealed this

Seventeenth Day of September, 1991

*Attest:*

HARRY F. MANBECK, JR.

*Attesting Officer*

*Commissioner of Patents and Trademarks*